United States Patent [19]

Spörring

[11] Patent Number: 4,766,579

[45] Date of Patent: Aug. 23, 1988

[54] TIMEPIECE HAVING A CONTROL STEM CORRECTING MECHANISM WITH AT LEAST TWO SETTING POSITIONS

[75] Inventor: Jörg Spörring, Lucerne, Switzerland

[73] Assignee: Complications S.A., Canton of Neuchatel, Switzerland

[21] Appl. No.: 1,565

[22] Filed: Jan. 8, 1987

[30] Foreign Application Priority Data

Jan. 14, 1986 [CH] Switzerland ..... 120/86

[51] Int. Cl.[4] ..... G04B 17/12; G04B 27/00

[52] U.S. Cl. ..... 368/190; 368/185; 368/15; 368/16; 368/18; 368/37; 368/34

[58] Field of Search ..... 368/37, 184–189, 368/14–20, 190–199, 28–39

[56] References Cited

U.S. PATENT DOCUMENTS

| | | | |
|---|---|---|---|
| 3,659,413 | 5/1972 | Tanaka et al. | 368/34 |
| 3,703,805 | 11/1972 | Ganter et al. | 368/34 |
| 3,721,083 | 3/1973 | Jauch | 58/3 |
| 4,362,391 | 12/1982 | King et al. | 368/34 |
| 4,423,964 | 1/1984 | Griessen | 368/34 |
| 4,520,291 | 9/1985 | Dubois | 368/34 |
| 4,674,889 | 6/1987 | Klaus | 368/34 |

FOREIGN PATENT DOCUMENTS

| | | | |
|---|---|---|---|
| 2263522 | 7/1973 | Fed. Rep. of Germany | 368/34 |
| 658570 | 5/1973 | Switzerland | 19/24 |
| 573617 | 3/1976 | Switzerland | 368/34 |
| 627042 | 12/1981 | Switzerland | 27/02 |
| 651172 | 9/1985 | Switzerland | 19/26 |

*Primary Examiner*—Bernard Roskoski

*Attorney, Agent, or Firm*—Silverman, Cass, Singer & Winburn, Ltd.

[57] ABSTRACT

A basic clockwork, initially arranged in such a way as to comprise two supplementary indicators, of the date and of the days of the week, which have been removed, is provided with an additional module carrying supplementary indicators, which can number two, three or even four. These indicators being separate from the basic clockwork, their position can be chosen very freely by a constructor. In order to prevent having to provide the clockwork with one or several supplementary control members, for the correction of said indicators, a correcting mechanism of the basic clockwork, comprising a control stem operating a sliding pinion is used. A shaft of the sliding pinion has been extended up to a frame of the additional module and carries a pinion meshing, according to the sense in which the control stem is operated, either with a wheel belonging to a correcting gear train of one of the supplementary indicators, or with a pinion belonging to a correcting gear train of another supplementary indicator.

9 Claims, 3 Drawing Sheets

TIMEPIECE HAVING A CONTROL STEM CORRECTING MECHANISM WITH AT LEAST TWO SETTING POSITIONS

BACKGROUND OF THE INVENTION (a) Field of the Invention

This invention relates to clockwork for a timepiece.

(b) Description of the Prior Art

Clockwork for timepieces are known in which a basic clockwork without an additional module is provided with supplementary indicating members, other than the ones which serve to indicate the time (hours, minutes and seconds), for example indicators of the date and of the days of the week, and said clockwork comprises driving means and correcting means for these supplementary indicators.

To enable greater freedom in determining the position on the dial of these supplementary indicators, as well as being able to increase the number of these supplementary indicators, some constructors have adopted a solution in which an additional module is provided containing the driving mechanism or mechanisms of the supplementary indicators driven by one of the movable elements of the basic clockwork, by means, typically, of a supplementary hour-wheel engaged with an hour-wheel of the basic clockwork.

A drawback of this arrangement, without speaking of the fact that it unavoidably increases the thickness of the clockwork which, however, can be held to acceptable limits, lies in the fact that correction of the supplementary indicators is made by means of one or even several control members which are distinct from a setting stem of the basic clockwork. This is not convenient for the user and increases the number of passages through the watch casing, thus creating obvious sealing problems.

SUMMARY OF THE INVENTION

The object of the present invention is to provide a clockwork for a timepiece having supplementary indicators, driving mechanisms of which are carried by an additional module, and in which correction of the supplementary indicators can be effected by means of a setting stem of a basic clockwork of the timepiece.

This is achievable by using a clockwork having supplementary indicators carried by the basic clockwork, with a correcting mechanism which has a control or setting stem able to occupy at least two axial positions in one of which the correcting mechanism is operable, the correcting mechanism having a sliding pinion, and removing from this basic clockwork the supplementary indicators and their driving mechanisms; by adding to this basic clockwork an additional module carrying a driving mechanism or mechanisms of at least two supplementary indicators and their corresponding correction gear train; and by extending the sliding pinion of the correcting mechanism of the basic clockwork, i.e. a shaft of this pinion, so that it engages the additional module, and adding to this pinion, at the level of the additional module, a pinion meshing alternatively according to the sense in which the control stem is operated with one or the other of the correcting gear trains of the supplementary indicators. This provides the basis for a timepiece clockwork fulfilling the object of the present invention as defined in claim 1.

The clockwork of the invention comprises a basic clockwork provided with a manually operable control mechanism having a stem able to occupy at least two axial positions, one of which serves in the setting of the time indicators and the other one of which serves in the correction of the other indicating members by means of a correcting mechanism having a sliding pinion, an additional module is secured to the basic clockwork and carries a driving mechanism of at least two indicators, the sliding pinion of the correcting mechanism of the basic clockwork extends up to the additional module and carries, at the level of this additional module, a pinion operatively meshing alternatively, according to the sense in which the control stem is operated, with a correction gear train of one or of the other of said two indicators in order to permit the correction thereof.

The various features of the invention will be apparent from the following description, drawings and claims, the scope of the invention not being limited to the drawings themselves as the drawings are only for the purpose of illustrating ways in which the principles of the invention can be applied. Other embodiments of invention utilising the same or equivalent principles may be used and structural changes may be made as desired by those skilled in the art without departing from the present invention and the purview of the appended claims.

BRIEF DESCRIPTION OF THE DRAWINGS

FIG. 8 1s a diagrammatic plan view, to a larger scale, of a part of the additional module of the watch of FIG. 7.

DESCRIPTION OF THE PREFERRED EMBODIMENTS

Figure 6:
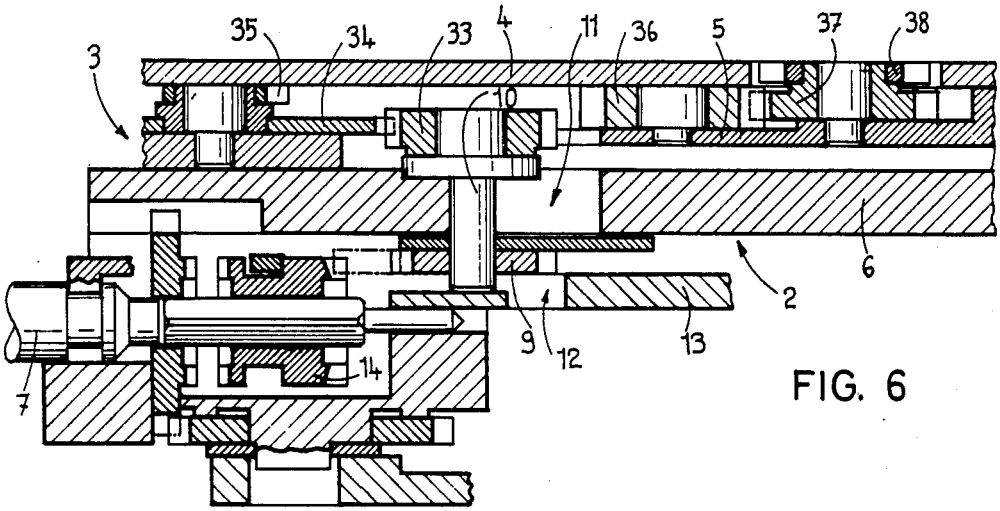
FIG. 6 is a sectional view on the broken lines VI—VI of FIG. 2, in which a manually operable control mechanism carried by a basic module is illustrated.
Figure 7:
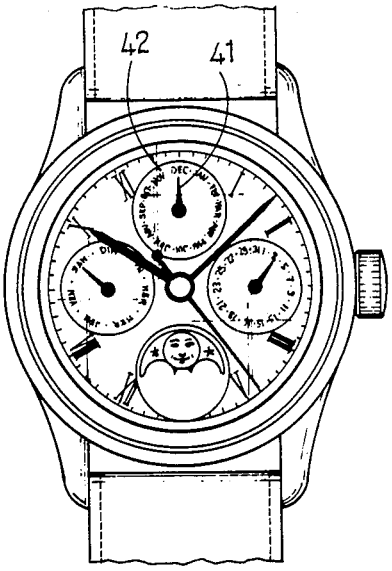
FIG. 7 is a plan view, similar to that of FIG. 1, of a modification of a wrist-watch comprising a fourth supplementary indicator, i.e. an indicator of the months of the year.
Figure 8:
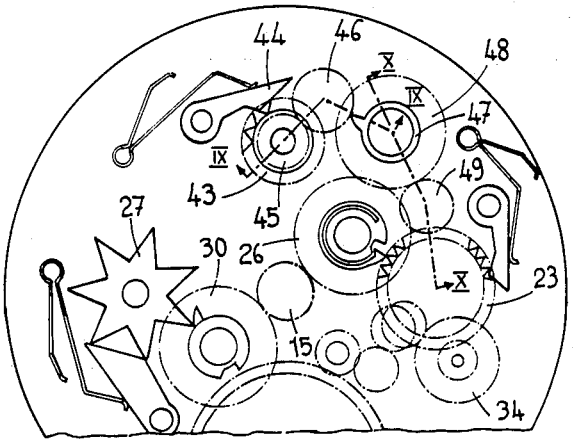
Figure 9:
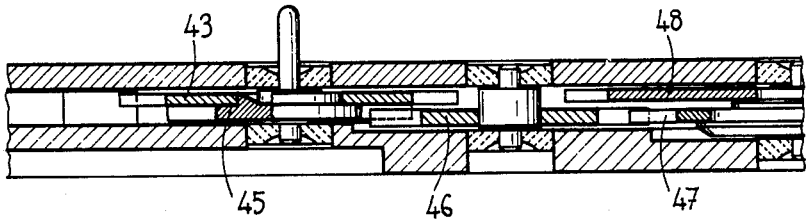
FIG. 9 is a sectional view on the line IX—IX of FIG. 8, to a larger scale.
Figure 10:
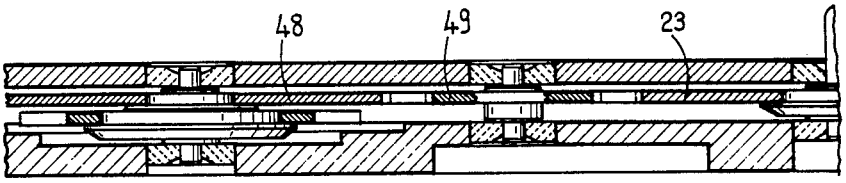
FIG. 10 is a sectional view on the line X—X of FIG. 8, also to a larger scale.

A watch according to a first embodiment of the invention, generally designated by reference 1, comprises clockwork constituted by a basic clockwork 2, which is partially illustrated in FIG. 6, and of an additional module 3 the frame of which, comprising two base plates 4 and 5, is secured to the base plate 6 of the basic clockwork 2.

Figure 1:
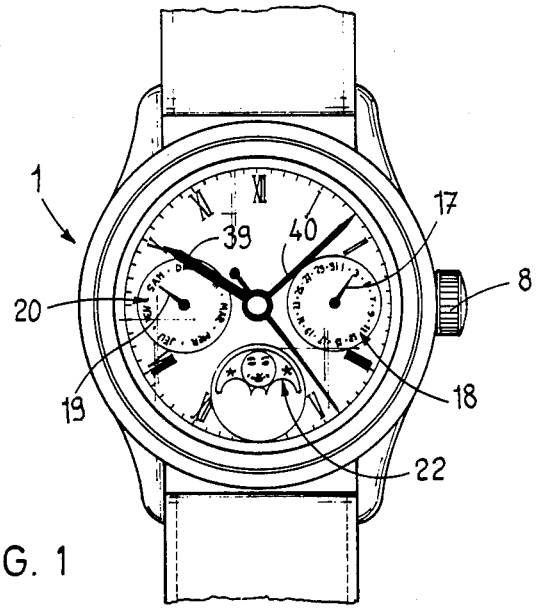
FIG. 1 is a plan view of a wrist-watch having three supplementary indicators, i.e. an indicator of the date, an indicator of the days of the week and an indicator of the phases of the moon.
Figure 2:
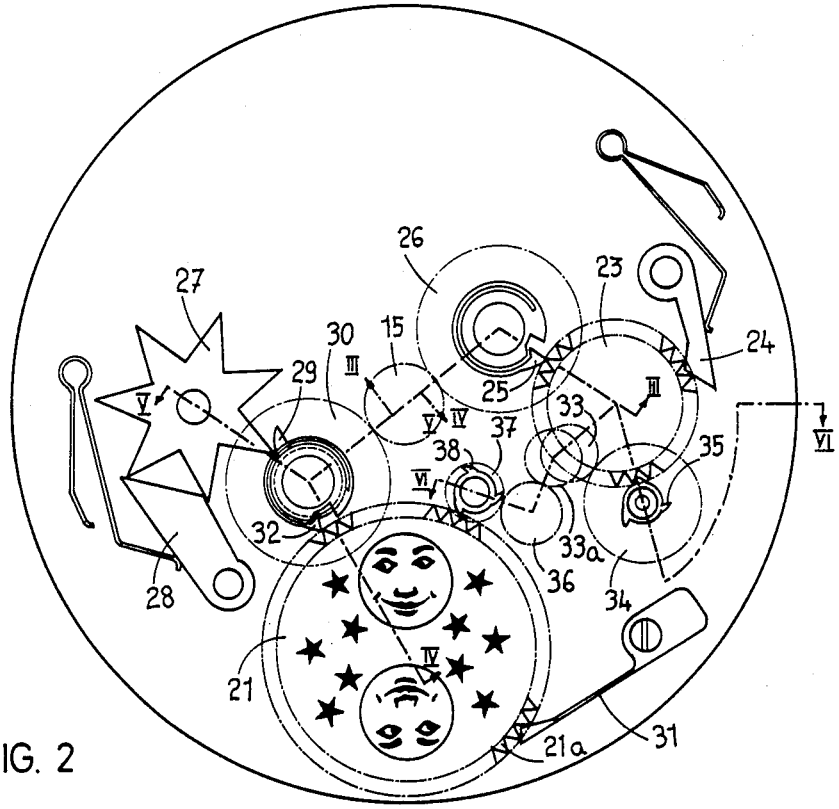
FIG. 2 is a diagrammatic plan view, to a larger scale, of an additional module of the watch represented in FIG. 1.
Figure 3:
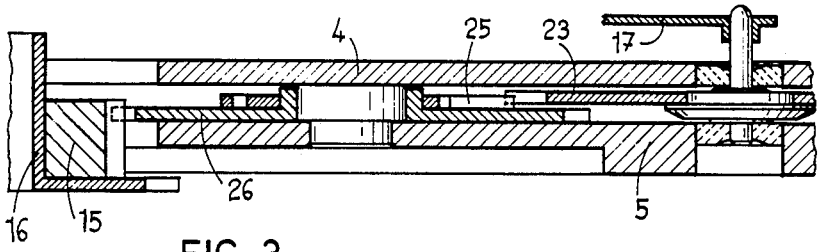
FIG. 3 is a sectional view on the line III—III of FIG. 2, to a larger scale.
Figure 4:
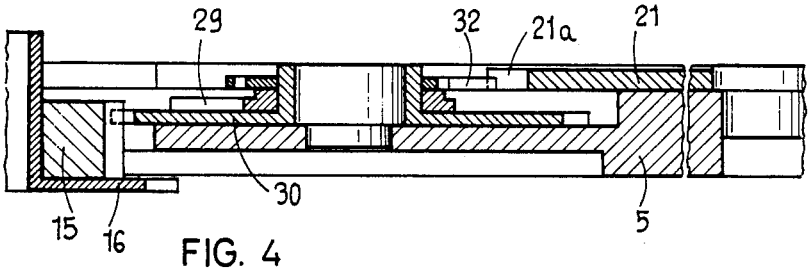
FIG. 4 is a sectional view on the line IV—IV of FIG. 2, to a larger scale.
Figure 5:
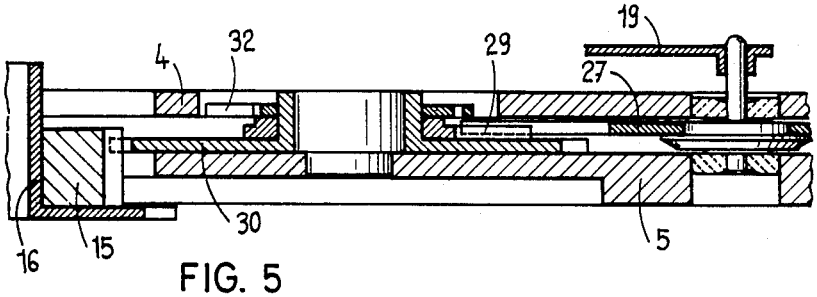
FIG. 5 is a sectional view on the line V—V of FIG. 2, to a larger scale.

The basic clockwork 2 comprises a manually operable control mechanism comprising a radial stem 7 (FIG. 6) carrying a control crown 8 (FIG. 1). The stem 7 can occupy three different axial positions of which the two end positions, respectively pushed home and pulled fully out, serve respectively in winding and in setting of the watch 1 and the third intermediate position of which, shown in FIG. 6, serves in the correction of supplementary indicators of the date and of the days of the week, which the basic clockword 2 was initially provided with and which have been removed. In the case where the watch 1 is an electronic watch, the pushed home position of the stem 7 is a neutral position in which rotation of the stem effects no function. A correction mechanism for the supplementary indicators, which has been retained in the watch 1 and is used, comprises a sliding pinion 9 a shaft of which, designated by reference 10, moves in two elongate apertures 11 and 12 provided respectively in the base plate 6 and in an intermediate bridge 13. When the control stem 7 is in the intermediate position, as shown in flg. 6, its sliding pinion 14 drives through a setting wheel (not shown) the sliding pinion 9 which moves in one sense or the other according to the sense in which the stem 7 is rotated.

The basic clockwork 2 comprises moreover a supplementary hour-wheel 15, intended to drive supplementary indicators of this clockwork and which has been retained. This supplementary hour-wheel 15 is driven on a conventional hour-wheel 16.

The additional module 3 carries three supplementary indicators, i.e. a hand 17 (FIG. 1) rotating on a date-ring 18, a hand 19 rotating on a ring 20 of the days of the week, and a disc 21 carrying the indications of the phases of the moon, appearing through a window 22 of the dial of the watch.

The drive of the date indicator 17 is obtained, from the supplementary hour-wheel 15, by the following mechanism (FIGS. 2 to 5): the date-hand 17 is carried by a star-wheel 23 having thirty-one teeth which is engaged by a spring-loaded pawl 24 and which is operated, once per 24 hours, by a resilient control finger 25 carried by a wheel 26 itself meshing with the supplementary hour-wheel 15. The number of the teeth of the wheel 26 is double that of the wheel 15 so that the wheel 26 makes one revolution per 24 hours and its finger 25 drives the star-wheel 23 one step each day.

The driving mechanism of the indicator 19 of the days of the week is similar: this indicator is carried by a star-wheel 27 having seven teeth which is engaged by a pawl 28 and which a finger 29, rigid with a wheel 30 meshing with the supplementary hour-wheel 15, drives one step each 24 hours.

So far as the disc 21 of the phases of the moon is concerned, it is provided with toothing 21*a* of fifty-nine teeth engaged by a pawl 31, and with which co-operates, once per 24 hours, a resilient control finger 32 rigid with the wheel 30.

So as to permit correction of these three supplementary indicators 17, 19 and 21, the shaft 10 carrying the sliding pinion 9 has been extended with respect to the original shaft of the basic clockwork 2 so as to extend up to the frame 4–5 of the additional module 3. This shaft 10 carries a pinion 33 which, in one of its working positions shown in FIGS. 2 and 6, meshes with a wheel 34 rigid with a correcting star 35 and which, in its second working position, indicated at 33*a* in FIG. 2, meshes with an intermediate wheel 36 meshing with a pinion 37 rigid with a correcting star 38. The correcting star 35 co-operates with the star-wheel 23 of the date hand 17 while the correcting star 38 co-operates with the toothing 21*a* of the disc 21 of the phases of the moon. The indicators 17 and 21 can, this way, be corrected directly by the control stem 7 when the latter occupies its intermediate position shown in the drawing. It is to be noted that, since the control fingers 25 and 32 are resilient, correction can be effected at any time, even when these fingers are in mesh with the star-wheel they operate, without the risk of damage to the mechanism.

So far as correction of the indicator 19 of the days of the week is concerned, it can be effected by the stem 7 occupying its pulled-out position for setting the hands 39 and 40 of the hours and of the minutes respectively (FIG. 1): these hands being brought into the position where they indicate midnight and a to and fro movement of the control stem 7 being effected. The shape of the driving finger 29 and the rest positions of the star-wheel 27 are such that the latter is driven only in one sense, which enables correction of the indicator 19.

A modification illustrated in FIGS. 7 to 10 distinguishes from the first embodiment by the fact that the watch comprises a fourth supplementary indicator, i.e. a hand 41 (FIG. 7) rotating on a ring 42 of the months of the year.

The hand 41 is driven by and is rigid with a star-wheel 43 having twelve teeth which is engaged by a pawl 44. The star-wheel 43 is rigid with a wheel 45 meshing with an intermediate wheel 46 operated, once per month, by a control finger 47 rigid with a wheel 48 meshing with the wheel 26 previously described in relation to the first embodiment and which makes one revolution per thirty-one days.

The correcting of the months indicator 41 is effected by means of the control stem 7 occupying the intermediate correcting position: the star-wheel 23 of the days of the week, driven by the correcting star 35 (see first embodiment), itself drives the wheel 48 carrying the control finger 47 through an intermediate wheel 49. The wheel 48 and the intermediate wheel 49 have star-shaped teeth as wheel 23, the teeth of which are pointed and have adjoining lateral faces forming an angle of 60°. The operator starts with correction of the months indicator and then corrects the date indicator.

I claim:

1. Clockwork for a timepiece comprising a basic clockwork provided with a manually operable control mechanism having a control stem able to occupy at least two axial positions, a first one of which positions serves in the setting of the time indicators and a second one of which positions serves in the correction of other indicating members by means of a correcting mechanism having a first sliding pinion mounted on said control stem, and an additional module secured to said basic clockwork carrying a driving mechanism for at least two indicators, a second sliding pinion of said correcting mechanism of the basic clockwork extending up to said additional module and carrying, at the level of this additional module, a pinion operatively meshing alternatively according to the sense in which the control stem is operated, with a correction gear train of one or of the other of said two indicators in order to permit correction thereof, in which said additional module is mounted on said basic clockwork, said first sliding pinion of said correcting mechanism engaging said second sliding pinion mounted on a shaft extending substantially perpendicular to the sliding movement of said correcting mechanism first sliding pinion, said shaft carrying said operatively meshing pinion for correcting said other two indicators.

2. Cloclwork as claimed in claim 1, in which said at least two indicators indicate the date and the days of the week, respectively.

3. Clockwork as claimed in claim 1, in which said additional module carries a driving mechanism of a third indicator.

4. Clockwork as claimed in claim 3, in which said third indicator indicates the phases of the moon.

5. Clockwork as claimed in claim 3, in which said additional module carries a driving mechanism of a fourth indicator.

6. Clockwork as claimed in claim 5, in which said fourth indicator indicates the months of the year.

7. Clockwork as claimed in claim 1, in which said control stem of said manually operable control mechanism is arranged in such a way as to be able to occupy three axial positions, with the position in which it operates the correcting mechanism being an intermediate position.

8. Clockwork as claimed in claim 1, in which said second sliding pinion has a first position for correcting a first one of said two indicators and a second position for correcting a second one of said two indicators.

9. Clockwork as claimed in claim 8, in which said first position is obtained by operating said control stem in a first direction and said second position is obtained by operating said control stem in a second direction.

* * * * *